US007037631B2

(12) United States Patent
Wu et al.

(10) Patent No.: US 7,037,631 B2
(45) Date of Patent: May 2, 2006

(54) PHOTOCONDUCTIVE IMAGING MEMBERS

(75) Inventors: Jin Wu, Webster, NY (US); Liang-Bih Lin, Webster, NY (US); John S. Chambers, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 418 days.

(21) Appl. No.: 10/370,186

(22) Filed: Feb. 19, 2003

(65) Prior Publication Data

US 2004/0161683 A1 Aug. 19, 2004

(51) Int. Cl.
*G03G 5/05* (2006.01)

(52) U.S. Cl. ..... 430/59.1; 430/58.65; 430/58.8; 430/59.4; 430/59.5; 430/65; 430/96; 430/133

(58) Field of Classification Search ..... 430/59.1, 430/58.65, 58.8, 59.4, 59.5, 65, 96, 133
See application file for complete search history.

(56) References Cited

U.S. PATENT DOCUMENTS

| | | | | |
|---|---|---|---|---|
| 3,121,006 | A | 2/1964 | Middleton et al. | 96/1 |
| 3,871,882 | A | 3/1975 | Wiedemann | 96/1.5 |
| 4,265,990 | A | 5/1981 | Stolka et al. | 430/59 |
| 4,298,697 | A | 11/1981 | Baczek et al. | 521/27 |
| 4,338,390 | A | 7/1982 | Lu | 430/106 |
| 4,464,450 | A | 8/1984 | Teuscher | 430/59 |
| 4,560,635 | A | 12/1985 | Hoffend et al. | 430/106.6 |
| 4,587,189 | A | 5/1986 | Hor et al. | 430/59 |
| 4,921,769 | A | 5/1990 | Yuh et al. | 430/64 |
| 4,921,773 | A | 5/1990 | Melnyk et al. | 430/132 |
| 5,270,283 | A * | 12/1993 | Koshizuka et al. | 503/227 |
| 5,473,064 | A | 12/1995 | Mayo et al. | 540/141 |
| 5,482,811 | A | 1/1996 | Keoshkerian et al. | 430/135 |
| 5,493,016 | A | 2/1996 | Burt et al. | 540/139 |
| 5,645,965 | A | 7/1997 | Duff et al. | 430/59 |
| 5,871,877 | A | 2/1999 | Ong et al. | 430/59 |
| 5,874,193 | A | 2/1999 | Liu et al. | 430/59 |
| 6,127,078 | A * | 10/2000 | Omokawa et al. | 430/58.85 |
| 6,136,486 | A | 10/2000 | Nguyen | 430/66 |
| 6,383,699 | B1 * | 5/2002 | Yuh et al. | 430/65 |

* cited by examiner

*Primary Examiner*—John L Goodrow
(74) *Attorney, Agent, or Firm*—E. O. Palazzo

(57) ABSTRACT

A photoconductive imaging member including a supporting substrate, a hole blocking layer thereover, a crosslinked photogenerating layer and a charge transport layer, and wherein the photogenerating layer includes a photogenerating component and a vinyl chloride, allyl glycidyl ether, hydroxy containing polymer.

43 Claims, No Drawings

PHOTOCONDUCTIVE IMAGING MEMBERS

CROSS REFERENCE

There is illustrated in copending U.S. Ser. No. 10/369,816, Publication No. 20040161684, entitled Photoconductive Imaging Members, tiled concurrently herewith, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

RELATED PATENTS

Illustrated in U.S. Pat. No. 5,645,965, the disclosure of which is totally incorporated herein by reference, are photoconductive imaging members with perylenes and a number of charge transports, such as amines.

Illustrated in U.S. Pat. No. 5,874,193, the disclosure of which is totally incorporated herein by reference, are photoconductive imaging members with a hole blocking layer comprised of a crosslinked polymer derived from crosslinking an alkoxysilyl-functionalized polymer bearing an electron transporting moiety. In U.S. Pat. No. 5,871,877, the disclosure of which is totally incorporated herein by reference, there are illustrated multilayered imaging members with a solvent resistant hole blocking layer comprised of a crosslinked electron transport polymer derived from crosslinking a thermally crosslinkable alkoxysilyl, acyloxysilyl or halosilyl-functionalized electron transport polymer with an alkoxysilyl, acyloxysilyl or halosilyl compound, such as alkyltrialkoxysilane, alkyltrihalosilane, alkylacyloxysilane, aminoalkyltrialkoxysilane, and the like; illustrated in U.S. Pat. No. 5,482,811, the disclosure of which is totally incorporated herein by reference, are imaging members with photogenerating pigments of, for example, Type V hydroxygallium phthalocyanine.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a perylene photogenerating layer, which is preferably a mixture of bisbenzimidazo( 2,1-a-1', 2'-b)anthra(2,1,9-def:6,5,10-d'e'f') diisoquino-line-6,11-dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by the reaction of gallium chloride in a solvent, such as N-methylpyrrolidone, present in an amount of from about 10 parts to about 100 parts, and preferably about 19 parts with 1,3-diiminoisoindolene in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Further, illustrated in U.S. Pat. No. 5,645,965, the disclosure of which is totally incorporated herein by reference, are symmetrical perylene photoconductive members.

The appropriate components and processes of the above patents may be selected for the present invention in embodiments thereof.

BACKGROUND

This invention is generally directed to imaging members, and more specifically, the present invention is directed to multilayered photoconductive imaging members comprised of about 50 to about 70 crosslinked, for example from about 50 to about 70 percent crosslinked, which crosslinking is determined by nuclear magnetic resonance (NMR), photogenerating layer containing, for example, a photogenerating pigment or mixtures thereof and a thermally crosslinkable vinyl chloride copolymer, or a thermally crosslinkable vinyl chloride copolymer blend. Specific examples of the aforementioned crosslinkable components are vinyl chloride copolymers, such as a vinyl chloride/allyl glycidyl ether/hydroxypropyl methacrylate copolymer; crosslinkable vinyl chloride copolymer blends, such as a vinyl chloride/vinyl acetate/maleic acid and a vinyl chloride/vinyl acetate/allyl glycidyl ether copolymer blend with a weight ratio of, for example, about 80/20; a vinyl chloride/allyl glycidyl ether/hydroxypropyl methacrylate copolymer; a polymer blend of a vinyl chloride/vinyl acetate/maleic acid copolymer and a vinyl chloride/vinyl acetate/allyl glycidyl ether copolymer, and which components function primarily as a binder which crosslinks at high temperatures of, for example, from about 120° C. to about 300° C., and more specifically, from about 135° C. to about 160° C. resulting in excellent integrity of the charge generating layer, high adhesion characteristics between the photogenerating layer or charge generating layer, and other layers of the imaging member, such as the supporting substrate layer, the hole blocking layer. The hole blocking layer is preferably in contact with a supporting substrate, and more specifically, is situated between the supporting substrate and the photogenerating layer comprised, for example, of the photogenerating pigments of U.S. Pat. No. 5,482,811, the disclosure of which is totally incorporated herein by reference, especially Type V hydroxygallium phthalocyanine.

The imaging members of the present invention in embodiments exhibit excellent cyclic/environmental stability with little change in their photoinduced discharge curves (PIDC) after a number of charging/exposure cycles in varying environmental zones. The PIDC curves of the photoconductive imaging members were obtained with an electrical scanner set to obtain photoinduced discharge cycles, and sequenced at one charge-erase cycle followed by one charge-expose-erase cycle, wherein the light intensity is incrementally increased with cycling to produce a series of photoinduced discharge characteristic curves from which the photosensitivity and surface potentials at various exposure intensities are measured. Additional imaging members electrical characteristics can be obtained by a series of charge-erase cycles with incrementing surface potential to generate several voltage versus charge density curves, and wherein a scanner is equipped with a scorotron set to a constant voltage charging at various surface potentials. The devices or members are then tested with the exposure light intensity incrementally increased by means of regulating a series of neutral density filters; the exposure light source is a 780 nanometer light emitting diode. In embodiments the photoconductive imaging members of the present invention exhibit favorable photoinduced discharge curves, excellent adhesion characteristics, which are measured by a pull type adhesion test for the layers selected, strengthened interface connections between the layers, excellent hardness, low charge deficient spot (CDS) counts thus less small-spot print defects, which counts are measured by conducting a print test with two solid white and solid black documents; the solid white documents can be analyzed by scanning for spots that are less than about 0.5 millimeter in diameter; foreign contaminants which can generate large-spot print defects, and substantially no adverse changes in the imaging member performance over extended time periods. The aforementioned photoresponsive, or photoconductive imaging members can be negatively charged when the photogenerating layer is situated between the hole transport layer and the substrate.

Processes of imaging, especially xerographic imaging, and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this invention can be selected for color xerographic applications.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components disclosed include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder.

The uses of perylene pigments as photoconductive substances are also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds and the aryl amine charge transport can be selected for the imaging members of the present invention.

In U.S. Pat. No. 4,921,769, the disclosure of which is totally incorporated herein by reference, there are illustrated photoconductive imaging members with blocking layers of polyurethanes.

In U.S. Pat. No. 6,136,486, there is illustrated a polyvinyl butyral (PVB) binder for organic photoreceptors (OPC's).

SUMMARY OF THE INVENTION

It is a feature of the present invention to provide imaging members thereof with many of the advantages illustrated herein, such as excellent photoinduced discharge curve characteristics, cyclic and environmental stability, and acceptable charge deficient spot levels arising from dark injection of charge carriers.

Another feature of the present invention relates to the provision of layered photoresponsive imaging members that are responsive to near infrared radiation exposure.

It is yet another feature of the present invention to provide improved layered photoresponsive imaging members with a sensitivity to visible light, and which members possess improved coating characteristics, and wherein the charge transport molecules do not diffuse, or there is minimum diffusion thereof into the photogenerating layer.

Moreover, another feature of the present invention relates to the provision of layered photoresponsive imaging members with robust solvent resistant layers.

In a further feature of the present invention there are provided imaging members containing a thermally crosslinked layer of a photogenerating pigment of, for example, Type V hydroxygallium phthalocyanine and a vinyl chloride copolymer, such as vinyl chloride/allyl glycidyl ether/hydroxypropyl methacrylate copolymer, or a vinyl chloride copolymer blend, such as polymer blend of a vinyl chloride/vinyl acetate/maleic acid copolymer and a vinyl chloride/vinyl acetate/allyl glycidyl ether copolymer; and wherein there is present a blocking layer, a crosslinked polymer wherein the BCFM segments of the U.S. Pat. No. 4,921,769 patent are covalently attached to the polymer to achieve excellent resistance to solvent degradation, superior electron transport, and ease of fabrication of the blocking layer.

Aspects of the present invention relate to a photoconductive imaging member comprised of a supporting substrate, a hole blocking layer thereover, a photogenerating layer, and a charge transport layer and wherein the photogenerating layer contains a thermally crosslinkable vinyl chloride copolymer, such as a vinyl chloride/allyl glycidyl ether/hydroxypropyl methacrylate copolymer, or a thermally crosslinkable vinyl chloride copolymer blend, such as polymer blend of a vinyl chloride/vinyl acetate/maleic acid copolymer and a vinyl chloride/vinyl acetate/allyl glycidyl ether copolymer, and wherein a hole blocking layer is present and is comprised, for example, of phenolic resin and at least one metal oxide, or phenolic resin, oligomers of phenolic resin and at least one metal oxide, 3-aminopropyltrimethoxysilane or 3-aminopropyltriethoxysilane, tributoxyzirconium acetylacetonate and polyvinyl butyral, or polyvinylbenzyl alcohol and copolymers with polyvinyl benzyl acetate and at least one metal oxide, a crosslinkable polycarbonate with BCFM an electron transport and at least one metal oxide, or polyamides, such as Elvamide and LUCKAMIDE™; a photoconductive imaging member comprised in the following sequence of a supporting substrate, a hole blocking polymer layer, an adhesive layer, a photogenerating layer and a charge transport layer; a photoconductive imaging member wherein an adhesive layer is present and is comprised of a polyester with an $M_w$ of from about 20,000 to about 100,000, and preferably about 35,000, and an $M_n$ of from about 10,000 to about 50,000, and more specifically about 14,000; a photoconductive imaging member wherein the supporting substrate is comprised of a conductive metal substrate; a photoconductive imaging member wherein the conductive substrate is aluminum, aluminized or titanized polyethylene terephthalate belt (MYLAR®); a photoconductive imaging member wherein the photogenerating layer is of a thickness of from about 0.05 to about 10 microns; a photoconductive imaging member wherein the transport layer is of a thickness of from about 10 to about 50 microns; a photoconductive imaging member wherein the photogenerating layer component is comprised of photogenerating pigments dispersed in a crosslinkable resinous binder, and which component is present in an amount of from about 5 percent by weight to about 95 percent by weight; a photoconductive imaging member wherein the charge transport layer comprises aryl amine molecules; a photoconductive imaging member wherein the aryl amines are of the formula

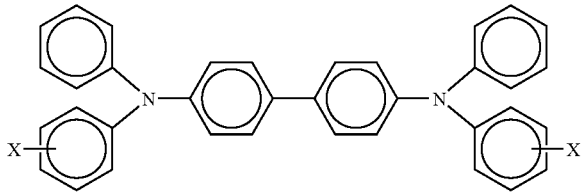

wherein X is selected from the group consisting of alkyl and halogen, and wherein the aryl amine is dispersed in a resinous binder; a photoconductive imaging member wherein the arylamine alkyl contains from about 1 to about 10 carbon atoms; a photoconductive imaging member wherein the arylamine alkyl contains from 1 to about 5 carbon atoms; a photoconductive imaging member wherein the arylamine alkyl is methyl, wherein halogen is chloride, and wherein the charge transport resinous binder is selected from the group consisting of polycarbonates and polystyrenes; a photoconductive imaging member wherein the aryl amine is N,N'-diphenyl-N,N-bis(3-methylphenyl)1,1'-biphenyl-4,4'-diamine; a photoconductive imaging member further including an adhesive layer of a polyester with an $M_w$ of about 70,000, and an $M_n$ of from about 25,000 to about 50,000, and preferably about 35,000; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed image to a suitable substrate; a photoconductive imaging member wherein the blocking layer is derived from the crosslinking of a polymer and an organosilane in the presence of a catalyst selected from the group consisting of carboxylic acids and amines; a photoconductive imaging member wherein acetic acid or an alkylamine is selected as the catalyst; an imaging member wherein a crosslinked siloxane polymer is selected as a hole blocking layer, and which polymer is generated from the reaction of a polymer and an organosilane; imaging members comprised of a supporting substrate, a hole blocking layer thereover, a photogenerating layer of, for example, hydroxygallium phthalocyanine, and a charge transport layer, and which hydroxygallium phthalocyanine is dispersed in a crosslinkable vinyl chloride copolymer such as a vinyl chloride/allyl glycidyl ether/hydroxypropyl methacrylate copolymer, or a vinyl chloride copolymer blend, such as polymer blend of a vinyl chloride/vinyl acetate/maleic acid copolymer and a vinyl chloride/vinyl acetate/allyl glycidyl ether copolymer; a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer; an imaging member wherein the polymer is a crosslinked vinyl chloride copolymer comprised of from about 60 to about 95 weight percent of vinyl chloride, from about 0.5 to about 10 weight percent of allyl glycidyl ether and from about 0.5 to about 10 weight percent of a hydroxy containing monomer or monomers, and wherein the total thereof is about 100 percent; an imaging member wherein the hydroxy containing monomer of the crosslinked vinyl chloride is a hydroxyalkyl (meth)acrylate, where alkyl possesses from about 2 to about 8 carbon atoms; vinyl alcohol; vinylbenzyl alcohol or vinyl phenol; an imaging member wherein the crosslinkable vinyl chloride is a vinyl chloride/allyl glycidyl ether/hydroxypropyl methacrylate copolymer; an imaging member wherein the crosslinkable vinyl chloride is a vinyl chloride/vinyl acetate/allyl glycidyl ether/hydroxybutyl methacrylate copolymer; an imaging member wherein the crosslinkable vinyl chloride is a vinyl chloride/allyl glycidyl ether/vinyl alcohol copolymer; an imaging member wherein the crosslinkable vinyl chloride is a vinyl chloride/allyl glycidyl ether/vinylbenzyl alcohol copolymer; an imaging member wherein the crosslinkable vinyl chloride is a vinyl chloride/allyl glycidyl ether/hydroxybenzylpropyl methacrylate copolymer; an imaging member wherein the crosslinking density is from about 55 to about 80 percent; an imaging member wherein the crosslinkable vinyl chloride copolymer possesses a number average molecular weight $M_n$ of from about 10,000 to about 60,000; an imaging member comprised of a supporting substrate, a hole blocking layer thereover, a photogenerating layer and a charge transport layer, and wherein the photogenerating layer is comprised of a photogenerating component and a crosslinkable vinyl chloride copolymer blend and wherein the blend is comprised of a first vinyl chloride copolymer comprised of a vinyl chloride acid containing monomer and vinyl acetate, and a second vinyl chloride copolymer comprised of a vinyl chloride, epoxy containing monomer and vinyl acetate; a photoconductive imaging member comprised of a hole blocking layer, a crosslinked photogenerating layer and a charge transport layer, and wherein the photogenerating layer is comprised of a photogenerating pigment and a vinyl halide/allyl glycidyl ether/hydroxyalkylmethacrylate copolymer; photoconductive imaging members comprised of a supporting substrate, a hole blocking layer thereover, a photogenerating layer and a charge transport layer, and wherein the hole blocking layer is comprised, for example, of a crosslinked polymer derived from the reaction of a silyl-functionalized hydroxyalkyl polymer of Formula (I) with an organosilane of Formula (II) and water (I)

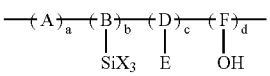

(II)

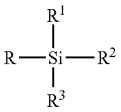

wherein A, B, D, and F represent the segments of the polymer backbone; E is an electron transporting moiety; X is selected from the group consisting of halide like chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide; a photoconductive member wherein the silyl-functionalized hydroxyalkyl polymer is represented by Formula (IV)

(IV)

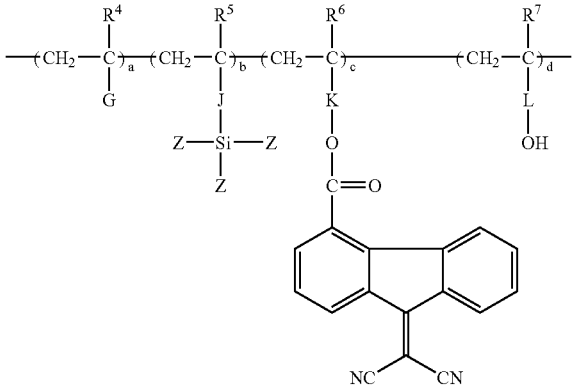

wherein $R^4$, $R^5$, $R^6$, and $R^7$ are independently selected from a hydrogen atom and alkyl; Z is selected from the group consisting of chloride, bromide, iodide, cyano, alkoxy, acyloxy; J, K and L are divalent linkages; G is aryl or alkoxycarbonyl; and a, b, c, and d are mole fractions of the repeating units of the polymer such that the sum of a+b+c+d is equal to 1; an imaging member wherein the hole blocking layer is comprised of crosslinked polymer schematically represented by (V) derived from the reaction of (IV) and an organosilane (II)

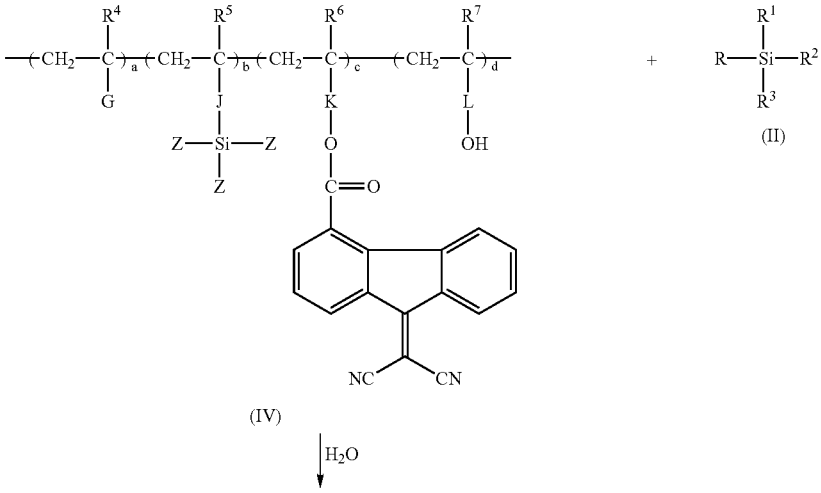

-continued

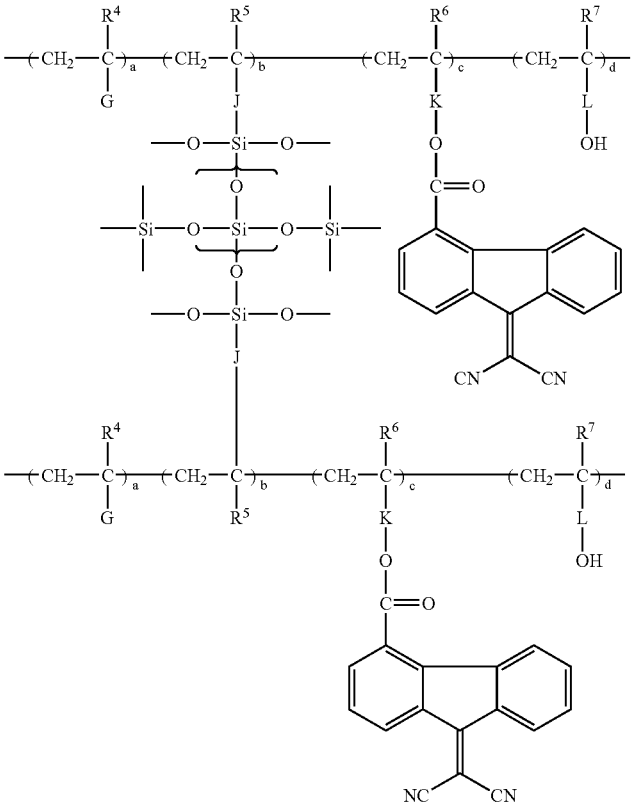

(V)

wherein $R^4$, $R^5$, $R^6$, and $R^7$ are hydrogen and alkyl; Z is selected from the group consisting of chloride, bromide, iodide, cyano, alkoxy, and acyloxy; J is a divalent linkage selected from the group consisting of alkyleneoxycarbonyl, arylene, alkylenearyl, aryleneoxycarbonyl, and alkylenearyloxycarbonyl; K is divalent linkage selected from the group consisting of arylene, alkylarylene, alkyleneoxycarbonyl, aryleneoxycarbonyl; L is selected from the group consisting of arylene, alkylenearylene, and alkyleneoxycarbonyl; G is selected from the group consisting of bromide, chloride, iodide, cyano, aryl, alkoxycarbonyl, and aryloxycarbonyl; a, b, c, and d are the mole fractions of the repeating units of the polymer, such that the sum of a+b+c+d is equal to 1; and R is alkyl, substituted alkyl, aryl, or substituted aryl, with the substituent being halogen, alkoxy, aryloxy, or amino; and $R^1$, $R^2$, and $R^3$ are independently selected from the group consisting of alkyl, aryl, alkoxy, aryloxy, acyloxy, halide, cyano, and amino provided that two of $R^1$, $R^2$, and $R^3$ are independently selected from the group consisting of alkoxy, aryloxy, acyloxy, and halide; a photoconductive imaging member wherein organosilane (II) is selected from the group consisting of methyltrichlorosilane, dimethyldichlorosilane, methyltrimethoxysilane, methyltriethoxysilane, ethyltrichlorosilane, ethyltrimethoxysilane, dimethyldimethoxysilane, methyltriethoxysilane, ethyltriethoxysilane, propyltrimethoxysilane, 3-aminopropyltrimethoxysilane, and 3-aminopropyltriethoxysilane; a crosslinked polymer of Formula (III)

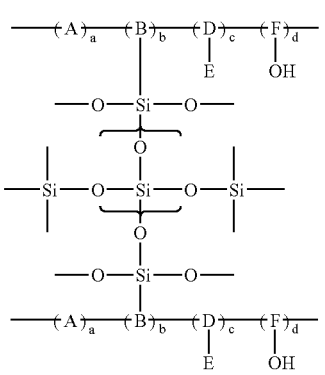

(III)

wherein E is an electron transport moiety; A, B, D and F represent segments of the polymer backbone; and a, b, c, and d represent mole fractions of the repeating units wherein the sum of a+b+c+d is equal to about 1; a photoconductive imaging member comprised of a hole blocking layer, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II)

(I)

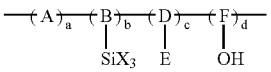

(II)

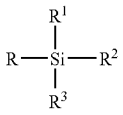

wherein A, B, D, and F represent the segments of the polymer backbone; E is an electron transporting moiety; X is cyano, alkyl, alkoxy, halide, aryl, aryloxy, or acyloxy; a, b, c, and d are mole fractions of the repeating monomers; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide; and a photoconductive imaging member comprised in sequence of a supporting substrate, a hole blocking layer, a photogenerating layer and a charge transport layer, and wherein the hole blocking layer is comprised of a polymer generated from the reaction of a silyl-functionalized hydroxyalkyl polymer of Formula (I) with an organosilane of Formula (II)

(I)

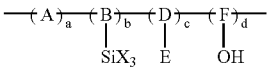

(II)

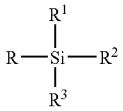

wherein A, B, D, and F represent the segments of the polymer backbone; E is an electron transporting moiety; X is halide, aliphatic, aryl, or cyano; a, b, c, and d represent mole fractions of the repeating monomer units; R is aliphatic or aryl, and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

With further respect to the present invention in embodiments thereof, the photogenerating layer is comprised of a mixture of a photogenerating component, such as a pigment or mixtures of pigments, and a resinous binder of a crosslinkable vinyl chloride copolymer, such as a vinyl halide/allyl glycidyl ether/hydroxyalkyl methacrylate or a crosslinkable vinyl chloride copolymer blend of, for example, from about 80/20 to about 70/30 (weight/weight) polymer blend of a vinyl chloride/vinyl acetate/maleic acid copolymer and a vinyl chloride/vinyl acetate/allyl glycidyl ether copolymer. The crosslinking is induced usually by thermal cure, however, other methods of crosslinking include e-beam, UV and X-ray radiation.

The vinyl chloride copolymer binder is illustrated with regard to the following formula

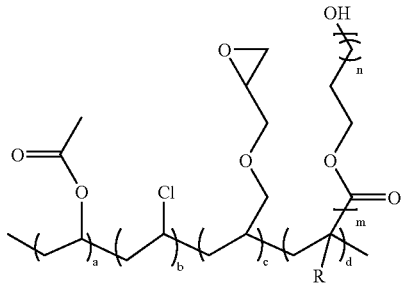

where R=H or an alkyl, such as a methyl group, n=0 to about 10, m=0 and 1, a=0 to about 30 weight percent, b=about 60 to about 95 weight percent, c=about 0.5 to about 10 weight percent and d=about 0.5 to about 10 weight percent.

These random copolymers are comprised, for example, of from about 60 to about 95 weight percent of vinyl chloride, from about 0.5 to about 10 weight percent of allyl glycidyl ether, from about 0.5 to about 10 percent of a hydroxy containing monomer, such as hydroxyalkyl methacrylate, hydroxyalkyl acrylate, vinyl alcohol, vinylbenzyl alcohol, vinyl phenol, and the like, and optionally from 0 to about 30 weight percent of vinyl acetate. During crosslinking, the —OH groups on one copolymer chain can interact with the glycidyl groups on the same chains or other copolymer chains. Specific examples of copolymers include MR-110, a vinyl chloride/allyl glycidyl ether/hydroxypropyl methacrylate copolymer (a=0, R=methyl, m=1 and n=1), available from Nippon Zeon Company, Ltd.

For the vinyl chloride copolymer blend binder, the functional groups, such as acid on first vinyl copolymer, can interact with the functional groups, such as glycidyl on second vinyl copolymer, during crosslinking. Examples of these copolymers are:

first vinyl chloride copolymer

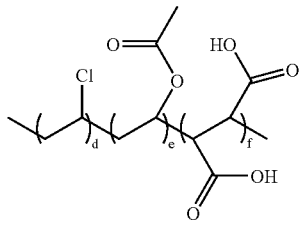

where d=about 60 to about 95 weight percent, e=0 to about 30 weight percent, and f=about 0.5 to about 5 weight percent;

second vinyl chloride copolymer

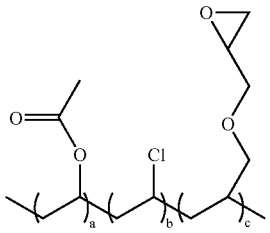

where a=about 0 to about 30 weight percent, b=about 60 to about 95 weight percent, and c=about 0.5 to about 20 weight percent. More specifically, the first vinyl chloride copolymer is comprised, for example, of from about 60 to about 95 weight percent of vinyl chloride, from about 0.5 to about 5 weight percent of an acid containing monomer, such as maleic acid, or (meth)acrylic acid, and from 0 to about 30 weight percent of vinyl acetate, and wherein the second vinyl chloride copolymer is comprised, for example, of from about 60 to about 95 weight percent of vinyl chloride, from about 0.5 to about 20 weight percent of allyl glycidyl ether, and from 0 to about 30 weight percent of vinyl acetate. Examples of the first vinyl chloride copolymer include VMCH ($M_n$=27,000, $T_g$=74° C.), VMCC ($M_n$=19,000, $T_g$=72° C.) and VMCA ($M_n$=15,000, $T_g$=70° C.), all vinyl chloride/vinyl acetate/maleic acid copolymers available from Dow Chemical, VINNOL E/15/45M ($T_g$=76° C.), E15/48M ($T_g$=76° C.) and H15/45M ($T_g$=79° C.), all vinyl chloride/vinyl acetate/acid containing monomer copolymers available from Wacher Polymer Systems, and the like. Examples of the second vinyl chloride copolymer include VERR-40 ($M_n$=15,000, $T_g$=67° C.), a vinyl chloride/vinyl acetate/epoxy containing monomer copolymer available from Dow Chemical, and the like.

The photogenerating layer is comprised, for example, of from about 5 to about 95 weight percent, preferably from about 40 to about 70 weight percent of a photogenerating pigment including titanyl phthalocyanines, perylenes, alkylhydroxygallium phthalocyanines, hydroxygallium phthalocyanines and the like, or mixtures thereof, and from about 95 to about 5 weight percent, preferably from about 60 to about 30 weight percent of the crosslinkable vinyl chloride copolymer, or a crosslinkable vinyl chloride copolymer blend wherein the first acid containing vinyl chloride copolymer is present in an amount of from about 40 to about 95 weight percent, and preferably from about 60 to about 80 weight percent of the blend, and the second epoxy containing vinyl chloride copolymer is present in an amount of from about 60 to about 5 weight percent, and preferably from about 40 to about 20 weight percent of the blend.

The solvents selected for the photogenerating layer dispersion include n-butyl acetate, isobutyl acetate, methyl acetate, ethyl acetate, propyl acetate, isopropyl acetate, isophorone, cyclohexanone, methyl isobutyl ketone, methyl ethyl ketone, methyl propyl ketone, acetone, methyl isoamyl ketone, methyl n-amyl ketone, diisobutyl ketone, diacetone alcohol, xylene and toluene, or mixtures of them. The photogenerating layer dispersions can, for example, be prepared by milling the ingredients with milling media, such as glass, $ZrO_2$ or stainless steel beads, through a dynomill, roll mill or attritor mill. Subsequent to the coating of the photoconductive imaging member layers, there results a photogenerating layer that is thermally crosslinked from, for example, about 50 to about 90 percent crosslinking, which is measured by nuclear magnetic resonance (NMR) technique, and which crosslinking is primarily between the polymeric binder chains, and also in embodiments between the polymeric binder chains and the photogenerating pigment. The crosslinking conditions are curing at from about 120° C. to about 300° C., more specifically from about 135° C. to about 160° C. for about 30 to about 120 minutes, more specifically from about 40 to about 60 minutes. With the photoreceptor architecture described in this invention, an extra curing step of photogenerating layer before coating charge transport layer is unnecessary since drying of charge transport layer would cure the photogenerating layer simultaneously, which results in excellent adhesion between charge transport layer and photogenerating layer, as well as between hole blocking layer and photogenerating layer. However, an extra cure step of photogenerating layer can be added to the fabrication sequence.

Illustrative examples of substrate layers selected for the imaging members of the present invention and which layer can be opaque or substantially transparent may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of a minimum thickness providing there are no adverse effects on the member. In embodiments, the thickness of this layer is from about 75 microns to about 275 microns.

The photogenerating layer, which is preferably comprised of hydroxygallium phthalocyanine Type V, is in embodiments comprised of, for example, preferably from about 70 to about 40 weight percent of the Type V and from about 30 to about 60 weight percent of a crosslinkable resinous binder or a crosslinkable resin binder mixture. The photogenerating layer can contain known photogenerating pigments, such as metal phthalocyanines, metal free phthalocyanines, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components, such as selenium, especially trigonal selenium. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of the layer in an embodiment is dependent primarily upon factors, such as photosensitivity, electrical properties and mechanical considerations. More specifically, the crosslinked photogenerating layer comprised of a photogenerating pigment or a mixture of photogenerating pigments and a crosslinkable vinyl chloride copolymer, such as vinyl chloride/allyl glycidyl ether/hydroxypropyl methacrylate copolymer, is selected in a preferable weight ratio of from about 70/30 to about 40/60 of photogenerating pigment to the crosslinkable vinyl chloride copolymer such as vinyl chloride/allyl glycidyl ether/hydroxypropyl methacrylate copolymer. Furthermore and specifically, the crosslinked photogenerating layer is comprised of a photogenerating pigment or a mixture of photogenerating pigments and a crosslinkable vinyl chloride copolymer blend wherein the first vinyl chloride copolymer contains acid groups, such as vinyl chloride/vinyl acetate/maleic acid copolymer, and the second vinyl chloride copolymer contains epoxy groups, such as vinyl chloride/vinyl acetate/allyl glycidyl ether copolymer. The preferable weight ratio of pigment to blend binder ranges from about 70/30 to about 40/60, and the preferable weight ratio of the first binder to second binder within the copolymer blend binder system ranges from about 60/40 to about 80/20.

The coating of the photogenerating layers in embodiments of the present invention can be accomplished with spray, dip or wire-bar methods such that the final dry thickness of the photogenerating layer is, for example, from about 0.01 to about 30 microns, and more specifically, from about 0.1 to about 15 microns after being dried at, for example, about 40° C. to about 150° C. for about 15 to about 90 minutes.

Illustrative examples of the additional polymeric binder materials that can be selected for the photogenerating layer are as indicated herein, and include those polymers as disclosed in the relevant U.S. patents recited herein, and in U.S. Pat. No. 3,121,006, the disclosure of which is totally incorporated herein by reference. In general, the effective amount of polymer binder that is utilized in the photogenerating layer ranges from about to about 95 weight percent, and more specifically, from about 30 to about 60 weight percent of the photogenerating layer.

As optional adhesives usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, conductive and nonconductive particles, such as zinc oxide, titanium dioxide, silicon nitride, carbon black, and the like, to provide, for example, in embodiments of the present invention further desirable electrical and optical properties.

Aryl amines selected for the hole transporting layers, which generally are of a thickness of from about 5 microns to about 75 microns, and preferably of a thickness of from about 10 microns to about 40 microns, include molecules of the following formula

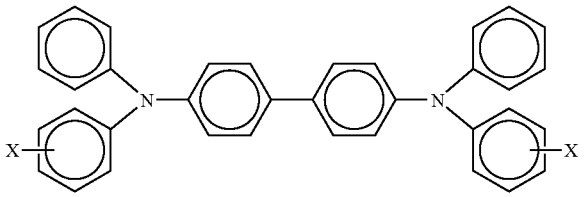

dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Photogenerating Layer With a Single Crosslinkable Binder:

The photogenerating layer dispersion was prepared by mixing 6 grams of MR-110 (a vinyl chloride/allyl glycidyl ether/hydroxypropyl methacrylate copolymer obtained from Nippon Zeon Company, Ltd., Tg=70° C.), 9 grams of Type V hydroxygallium phthalocyanine (HOGaPc C66), 88 grams of 2-hexanone, 22 grams of toluene and 200 grams of Glen Mill glass beads (1 to 1.25 millimeters in diameter). The dispersion was allowed to roll mill for 4 days. Then, the dispersion was filtered through a 20 μm cloth filter, and the filtrate was collected. The pigment particle size of the Type V hydroxygallium phthalocyanine, and rheology of the dispersion were measured, and the shelf life of the dispersion was documented. The viscosity of the dispersion as measured with a Rheometer was estimated at about 5.6 centipoises at a shear rate of 1 per second, and the rheological behavior of the dispersion appears Newtonian. The pigment particle size was measured as follows. The dispersion was diluted with 2-hexanone and vortex mixed for 2 minutes. The data showed that >99 percent of the particles had average diameters of less than 450 nanometers. After one month, the average particle diameter of the Type V hydroxygallium phthalocyanine in the dispersion did not change. The specific pigment sizes ranged from about 200 to about 300 nanometers in diameter. The crystal forms of HOGaPc pigments were measured by X-ray diffraction (XRD). The above dispersion was allowed to evaporate at ambient temperature, and the thin film thus formed was measured by XRD. The XRD crystallograph showed that the crystal forms were from Type V HOGaPc. Another experiment was done by curing the CGL film at 135° C. for 2 hours, and then the crosslinked film was measured by XRD. The crystallograph showed no change in HOGaPc crystal forms compared with that of the precured film indicating crosslinking of the binder had not changed the crystal forms of HOGaPc, which was important for the achievement of sensitivity of the pigment.

A number of devices were prepared using the invented CGL with different thickness. Thirty millimeter aluminum substrates were first coated with a 4 micron hole blocking layer (about 52 weight percent of $TiO_2$, about 38 weight percent of a phenolic resin, and about 10 weight percent of $SiO_2$ and cured at 145° C. for 45 minutes), then the above photogenerating layer was coated at different pull rate (usually higher pull rate results in thicker layer) using a Tsukiage coater. The photogenerating layer was dried at ambient conditions. Thereafter, there was applied a 24 micron charge transport layer (about 40 weight percent of N,N'-diphenyl-N,N-bis(3-methyl phenyl)-1,1'-biphenyl-4,4'-diamine and about 60 weight percent of a polycarbonate, PCZ-400 [poly(4,4'-dihydroxy-diphenyl-1-1-cyclohexane, $M_w$=40,000). The devices were dried at 135° C. for 1 hour. The generated PIDC curves were nominal with acceptable sensitivity of about 300, residual potential less than about 100 volts, and more specifically, from about 20 volts to about 60 volts, a dark decay less than about 30 volts, and more specifically from about 5 volts to about 15 volts, and a depletion voltage of less than about 100 volts, and more specifically from about 30 volts to about 60 volts. The sensitivity of the device increased with respect to the pull rate, thus the thickness of the CG (about 0.2 to about 1 μm, the exact thickness was difficult to measure, however, it was generally accepted that the thickness of the CG layer increased with the pull rate of the CG coating dispersion), indicated the homogeneity and robustness of the photogenerating layer. Charge deficient spots (CDS) were localized areas that have low or no charge which usually result in small-spot, usually less than 0.5 millimeter, print defects. CDS testing was also performed by allowing the devices to acclimate for 24 hours in an 80° C./80 percent humidity chamber. A print test was conducted consisting of two solid white and solid black documents. After the test, the solid white documents were analyzed by scanning for spots. With increasing thickness from about 0.2 μm to about 1 μm of the photogenerating layer (pull rate from about 30 to about 120 millimeters/minute), CDS counts or small-spot (<0.5 millimeter) print defects increased from about 153 to about 460; small-spot print defects increased with the thickness of the photogenerating layer.

EXAMPLE II

The Photogenerating Layer With a Crosslinkable Blend Binder:

A photogenerating layer dispersion was prepared by mixing 4.8 grams of VMCH (a vinyl chloride/vinyl acetate/maleic acid copolymer from Dow Chemical, $T_g$=74° C., $M_n$=27,000), 1.2 grams of VERR-40 (a vinyl chloride/vinyl acetate/epoxy containing monomer copolymer, $T_g$=67° C., $M_n$=15,000), 9 grams of Type V hydroxygallium phthalocyanine (HOGaPc C66 available from the Xerox Research Centre of Canada), 66 grams of methyl ethyl ketone, 44 grams of toluene and 200 grams of Glen Mill glass beads (about 1 to about 1.25 millimeters in diameter). The dispersion was allowed to roll mill for 6 days. Then, the dispersion was filtered from 20 μm cloth filter, and the filtrant was collected.

A photoconductive imaging member was then prepared by repeating the process of Example I, and which member enabled excellent developed images with minimum background dispersity as evidenced, for example, by excellent PIDC curves and low CDS (charge deficient spots) counts.

Other embodiments and modifications of the present invention may occur to those of ordinary skill in the art subsequent to a review of the information presented herein; these embodiments, modifications, equivalents thereof, substantial equivalents thereof, or similar equivalents thereof are also included within the scope of this invention.

What is claimed is:

1. A photoconductive imaging member comprised of a supporting substrate, a hole blocking layer thereover, a crosslinked photogenerating layer and a charge transport layer, and wherein the photogenerating layer is comprised of a photogenerating component and a crosslinked vinyl chloride copolymer comprised of a vinyl chloride, allyl glycidyl ether, hydroxy containing polymer, and wherein said charge transport layer is an arylamine of the formula

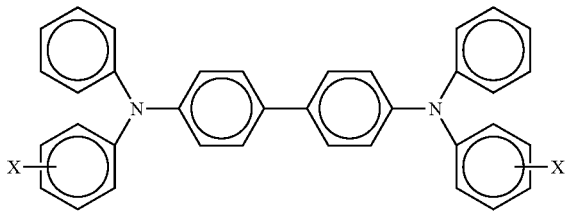

wherein X is selected from the group consisting of alkyl and halogen, and optionally wherein the aryl amine is dispersed in a resinous binder.

2. An imaging member in accordance with claim 1 wherein said polymer is a crosslinked vinyl chloride copoly mer comprised of from about 60 to about 95 weight percent of vinyl chloride, from about 0.5 to about 10 weight percent of allyl glycidyl ether and from about 0.5 to about 10 weight percent of a hydroxy containing monomer or monomers, and wherein the total thereof is about 100 percent.

3. An imaging member in accordance with claim 2 wherein the hydroxy containing monomer of said crosslinked vinyl chloride Is a hydroxyalkyl (meth)acrylate; vinyl alcohol; vinylbenzyl alcohol or vinyl phenol.

4. An imaging member in accordance with claim 2 wherein said crosslinkable vinyl chloride is a vinyl chloride/allyl glycidyl ether/hydroxypropyl methacrylate copolymer.

5. An imaging member in accordance with claim 2 wherein said crosslinkable vinyl chloride is a vinyl chloride/vinyl acetate/allyl glycidyl ether/hydroxybutyl methacrylate copolymer.

6. An imaging member in accordance with claim 2 wherein said crosslinkable vinyl chloride Is a vinyl chloride/allyl glycidyl ether/vinyl alcohol copolymer.

7. An imaging member in accordance with claim 2 wherein said crosslinkable vinyl chloride is a vinyl chloride/allyl glycidyl ether/vinylbenzyl alcohol copolymer.

8. An imaging member in accordance with claim 2 wherein said crosslinkable vinyl chloride is a vinyl chloride/allyl glycidyl ether/hydroxybenzylpropyl methacrylate copolymer.

9. An imaging member in accordance with claim 2 wherein said crosslinking measured by a density parameter is from about 55 to about 80 percent.

10. An imaging member in accordance with claim 2 wherein the crosslinkable vinyl chloride copolymer possesses a number average molecular weight $M_n$ of from about 10,000 to about 60,000.

11. An imaging member in accordance with claim 4 wherein said photogenerating component to said vinyl chloride/allyl glycidyl ether hydroxy/propyl methacrylate copolymer binder weight ratio is from about 5/95 to about 95/5.

12. An imaging member in accordance with claim 4 wherein said vinyl chloride/allyl glycidyl ether/hydroxypropyl methacrylate copolymer possesses a number average molecular weight $M_n$ of about 10,000 to about 40,000.

13. An imaging member in accordance with claim 1 wherein said photogenerating mixture is heated at a temperature of from about 120° C. to about 300° C.

14. An imaging member in accordance with claim 1 wherein said photogenerating mixture is heated at a temperature of from about 135° C. to about 160° C.

15. An imaging member comprised of a supporting substrate, a hole blocking layer thereover, a photogenerating layer and a charge transport layer, and wherein the photogenerating layer is comprised of a photogenerating component and a crosslinkable vinyl chloride copolymer blend wherein said blend's comprised of a first vinyl chloride copolymer comprised of a vinyl chloride acid containing monomer and vinyl acetate, and a second vinyl chloride copolymer comprised of a vinyl chloride, epoxy containing monomer and vinyl acetate, and wherein the charge transport layer is comprised of molecules of the formula

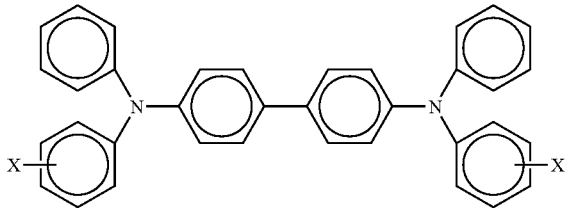

wherein X is selected from the group consisting of alkyl and halogen, and optionally wherein the aryl amine is dispersed in a resinous binder.

16. An imaging member in accordance with claim 15 wherein said first acid containing vinyl chloride copolymer is comprised of from about 60 to about 95 weight percent of vinyl chloride, from about 0.5 to about 5 weight percent of an acid containing monomer, and from 0 to about 30 weight percent of vinyl acetate.

17. An imaging member in accordance with claim 15 wherein the acid containing monomer of said acid containing monomer is maleic acid, methacrylic acid, acrylate acid, or vinyl benzoic acid.

18. An imaging member in accordance with claim 15 wherein said second epoxy containing vinyl chloride copolymer is comprised of from about 60 to about 95 weight percent of vinyl chloride, from about 0.5 to about 20 weight percent of epoxy containing monomer and from 0 to about 30 weight percent of vinyl acetate.

19. An imaging member in accordance with claim 15 wherein said second epoxy containing vinyl chloride copolymer is vinyl chloride/vinyl acetate/allyl glycidyl ether copolymer.

20. An imaging member in accordance with claim 15 wherein said epoxy containing monomer of said second epoxy containing vinyl chloride copolymer is allyl glycidyl ether.

21. An imaging member in accordance with claim 15 wherein said acid containing vinyl chloride copolymer is a vinyl chloride/vinyl acetate/maleic acid.

22. An imaging member in accordance with claim 15 wherein the weight ratio of said photogenerating component to said vinyl chloride copolymer blend binder is from about 40/60 to about 70/30, and which copolymer is crosslinked in an amount of from about 50 to about 90 percent.

23. An imaging member in accordance with claim 15 wherein the weight ratio of said acid containing vinyl chloride copolymer to said epoxy containing vinyl chloride copolymer is from about 60/40 to about 80/20.

24. An imaging member in accordance with claim 1 wherein said hole blocking layer is comprised of titanium oxide and a phenolic resin.

25. An imaging member in accordance with claim 1 comprised in the following sequence of said supporting substrate, a hole blocking layer, an optional adhesive layer, said photogenerating layer mixture and a said charge transport layer.

26. An imaging member in accordance with claim 25 wherein the adhesive layer is present and comprised of a polyester optionally with an $M_n$ of from about 50,000 to about 75,000, and an $M_n$ of about 25,000 to about 45,000.

27. An imaging member in accordance with claim 1 wherein the supporting substrate is comprised of a conductive metal substrate.

28. An imaging member in accordance with claim 27 wherein me conductive substrate is aluminum, aluminized polyethylene terephthalate or titanized polyethylene terephthalate.

29. An imaging member in accordance with claim 1 wherein said photogenerating layer is of a thickness of from about 0.05 to about 10 microns.

30. An imaging member in accordance with claim 1 wherein said charge transport layer is of a thickness of from about 10 to about 50 microns.

31. An Imaging member in accordance with claim 1 wherein the photogenerating layer is comprised of photogenerating pigments dispersed in said polymer, and which pigments are present in an amount of from about 5 percent by weight to about 95 percent by weight.

32. An imaging member in accordance with claim 1 wherein the photogenerating layer is comprised of photogenerating pigments dispersed in said polymer, and which polymer is comprised of a mixture of a vinyl chloride/vinyl acetate/maleic acid copolymer and a vinyl chloride/vinyl acetate/allyl glycidyl ether copolymer, and which photogenerating layer contains photogenerating pigments present in an amount of from about 5 weight percent to about 95 weight percent.

33. An imaging member in accordance with claim 1 wherein the aryl amine is N,N'-diphenyl-N,N-bis(3-methyl phenyl)-1,1'-biphenyl-4,4'-diamine.

34. An imaging member in accordance with claim 1 further including an adhesive layer of a polyester with an $M_w$ of from about 35,000 to about 70,000, and an $M_n$ of from about 25,000 to about 40,000.

35. An imaging member in accordance with claim 1 wherein the photogenerating layer is comprised of metal phthalocyanines or metal free phthalocyanines.

36. An imaging member in accordance with claim 1 wherein the photogenerating layer is comprised of titanyl phthalocyanines, perylenes, or hydroxygallium phthalocyanines.

37. An imaging member in accordance with claim 1 wherein the photogenerating layer is comprised of Type V hydroxygallium phthalocyanine.

38. A method of imaging which comprises generating an electrostatic latent image on the imaging member of claim 1, developing the latent image, and transferring the developed electrostatic image to a suitable substrate.

39. A photoconductive imaging member comprised of a hole blocking layer, a crosslinked photogenerating layer and a charge transport layer, and wherein the photogenerating layer is comprised of a photogenerating pigment and a vinyl halide/allyl glycidyl ether/hydroxyalkylmethacrylate copolymer, and wherein the charge transport layer is comprised of molecules encompassed by the formula

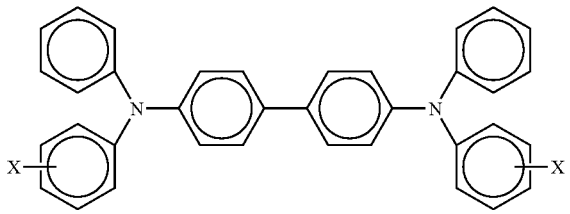

and wherein said photo generating is comprised of a hydroxy gallium phthalocyanine.

40. An imaging member in accordance with claim 39 wherein said crosslinking is from about 50 to about 90 percent.

41. An imaging member in accordance with claim 39 wherein the ratio of said hydroxy gallium phthalocyanine to said vinyl chloride/allyl glycidyl ether hydroxy/propyl methacrylate copolymer binder weight is from about 20/80 to about 80/20, or alternatively from about 40/60 to about 70/30.

42. An imaging member in accordance with claim 1 wherein said hole blocking layer is comprised of titanium oxide, silicon oxide, a phenolic resin and a phenolic oligomer; a polyvinyl butyral, silane, and an organometallic compound containing zirconium, or zinc oxide; or a polyvinyl butyral, and which layer is of a thickness of from about 0.2 to about 10 micrometers.

43. A photoconductive imaging member consisting essentially of a support substrate, a hole blocking layer thereover, a crosslinked photogenerating layer, and a charge transport layer, and wherein said photogenerating layer is free of a titanyl phthalocyanine photogenerating pigment and said charge transport layer is comprised of molecules of the formula

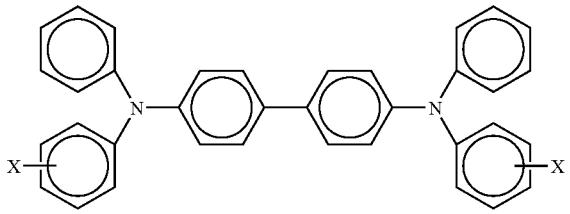

wherein X is alkyl or halogen, and wherein the photogenerating layer comprises a binder of vinyl chloride, allyl glycidyl ether, hydroxy containing polymer.

* * * * *